US005762543A

United States Patent [19]

Kasprzyk et al.

[11] Patent Number: 5,762,543

[45] Date of Patent: Jun. 9, 1998

[54] POLISHING APPARATUS WITH IMPROVED PRODUCT UNLOADING

[75] Inventors: Karl Kasprzyk, Gilbert, Ariz.; Isao Nagahashi, Fujisawa, Japan

[73] Assignee: Speedfam Corporation, Des Plaines, Ill.

[21] Appl. No.: 564,968

[22] Filed: Nov. 30, 1995

[51] Int. Cl.[6] ..... B24B 5/313; B24B 7/08; B24B 7/17

[52] U.S. Cl. ..... 451/262; 451/267; 451/282; 451/286; 451/290; 451/339

[58] Field of Search ..... 451/41, 259, 261, 451/262, 267, 278, 282, 286, 287, 290, 339

[56] References Cited

U.S. PATENT DOCUMENTS

| | | | |
|---|---|---|---|
| 4,635,401 | 1/1987 | Nakaji | 451/262 X |
| 5,099,614 | 3/1992 | Arai et al. | 451/262 X |
| 5,109,631 | 5/1992 | Biebesheimer et al. | 451/262 |
| 5,121,572 | 6/1992 | Hilscher | 451/262 X |
| 5,274,960 | 1/1994 | Karlsrud | 451/262 X |

FOREIGN PATENT DOCUMENTS

| | | | |
|---|---|---|---|
| 507939 | 12/1954 | Canada | 451/339 |

OTHER PUBLICATIONS

"Speedfam® Double Sided Machines", 16 page brochure, Speedfam Corporaion, Des Plaines, IL, © Copyright 1990.

*Primary Examiner*—Timothy V. Eley
*Attorney, Agent, or Firm*—Fitch, Even, Tabin & Flannery

[57] ABSTRACT

In a polishing machine for polishing parts between a table and an upper polishing head, the upper polishing head includes push rods to clear the workpieces after a polishing operation. A push ring engages the push rods as a polishing head is being raised, holding the workpieces in position on the table.

34 Claims, 8 Drawing Sheets

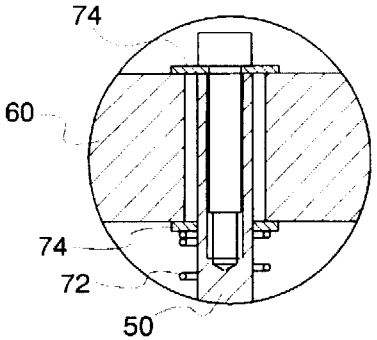
Fig. 7
Fig. 5
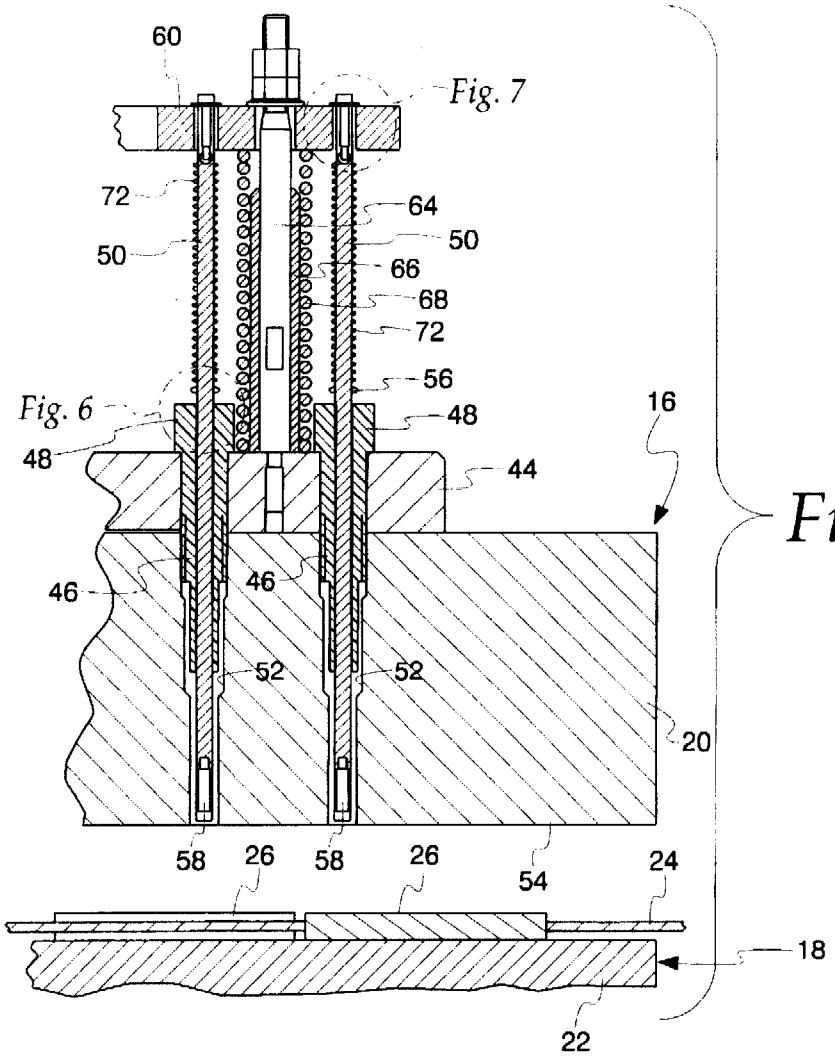
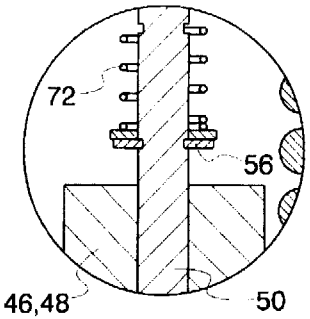
Fig. 6

16
20
24
22
44
26
$X_2 < X_1$
66
68
72
60
46
50
58
64
56
48
86

16
20
22
44
26
$X_1$
66
68
72
60
46
50
58
64
56
48
24

POLISHING APPARATUS WITH IMPROVED PRODUCT UNLOADING

BACKGROUND OF THE INVENTION

1. Field of the Invention:

The present invention pertains to the polishing of commercially important articles, such as hard disk blanks, and in particular to the polishing of articles using free abrasive machining techniques.

2. Description of the Related Art:

The polishing of thin, flat objects plays an important part in many commercial applications. For example, hard disk blanks are machined using free abrasive processes to flatten one or both major surfaces of the disk. Such flattening is carried out to a high degree of accuracy, so as to produce what is commonly termed a "mirror surface" or an "optically flat" surface. One example of a family of such machines is offered for sale by the Assignee of the present invention under the Model designation SFDSM. With these machines, both sides of a workpiece may be processed at the same time to achieve desired surface polishing.

In typical commercial scale operations, several workpieces are polished on one machine at one time. A machine operator's task, therefore, involves loading and unloading groups of workpieces with each machine cycle. Typically, polishing operations utilize water or water-borne abrasives, and this raises the possibility of creating suction forces between the workpieces and the machine, which make unloading difficult, increasing idle time of the machine. However, extraction of the workpieces cannot be hurried at the price of risking abrasion or other deterioration of the highly prepared surfaces which the machine is employed to attain.

SUMMARY OF THE INVENTION

It is an object of the present invention to provide an improved operation for polishing machines, especially those using free abrasive machining techniques.

Another object of the present invention is to provide polishing machines of the above-described type having improved speed in unloading of the workpieces.

Yet another object of the present invention is to provide polishing machines of the above-described type having unloading operations of improved reliability.

These and other objects according to principles of the present invention are provided in apparatus for polishing a workpiece, comprising:

a table for supporting the workpiece;

an upper head disposed above the table and movable toward the table so as to cooperate with the table to apply pressure to the workpiece to be polished, the upper head also movable away from the table to allow access to the workpiece for its removal from the apparatus;

means for moving at least one of the table and upper head with respect to the other so as to polish the workpiece;

a push plate carried on the upper head;

a plurality of push rods carried by the upper head so as to be engageable with the workpiece being polished; and means for moving the push plate in a direction toward and away from the table to move the push rods into and out of engagement with the workpiece being polished so as to separate the workpiece from the upper head.

BRIEF DESCRIPTION OF THE DRAWINGS

FIG. 5 is a fragmentary view taken from the right hand portion of FIG. 3, but with the machine in a partially open position;

FIG. 6 shows a fragment of FIG. 5 on an enlarged scale;

FIG. 7 shows a fragment of FIG. 5 on an enlarged scale;

DETAILED DESCRIPTION OF THE PREFERRED EMBODIMENT

Figure 1:
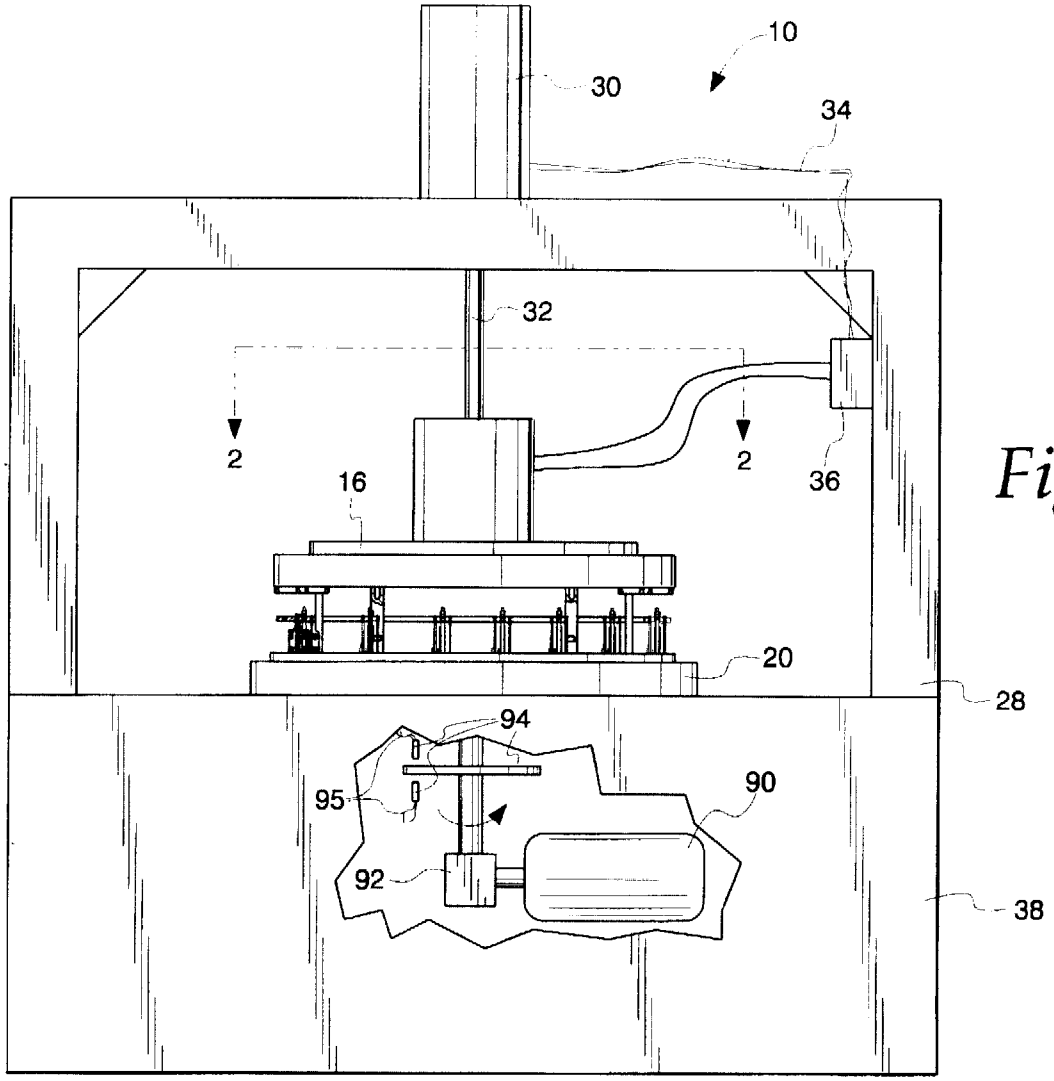
FIG. 1 is a top plan view of a polishing machine illustrating aspects of the present invention.
Figure 3:
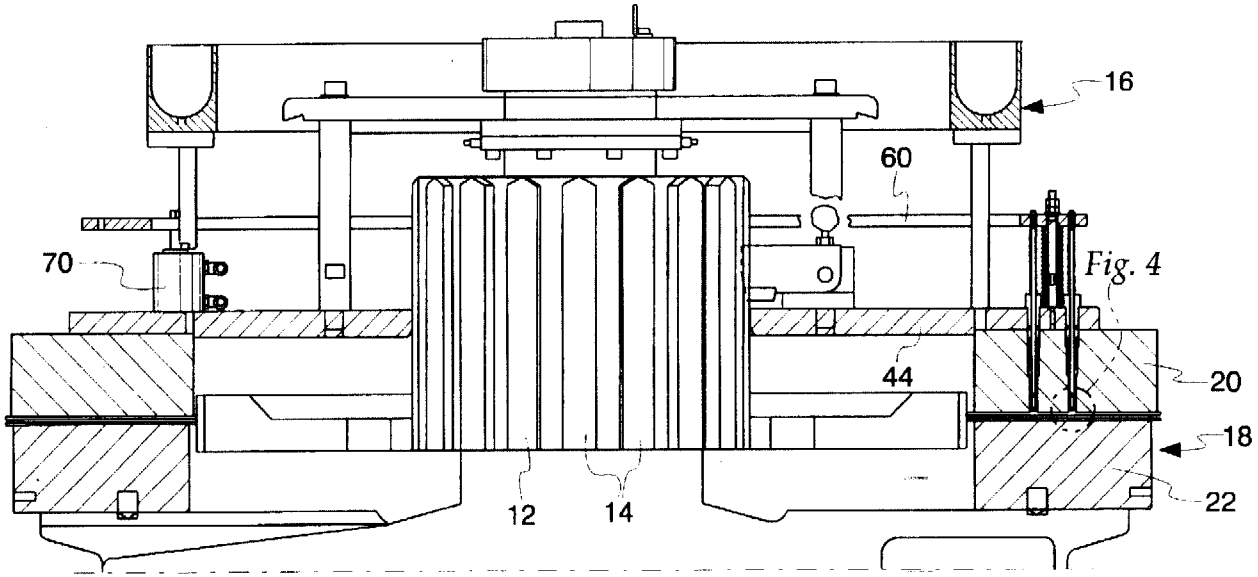
FIG. 3 shows a fragment of FIG. 2 on an enlarged scale.

Referring now to the drawings, FIG. 1 shows a polishing machine generally indicated at 10. Machine 10 includes a central core 12 with a plurality of alignment teeth. As can be seen in FIG. 3, the alignment teeth are elongated and extend in generally vertical directions. The alignment teeth help guide an upper head assembly generally indicated at 16 into engagement with a lower table assembly generally indicated at 18. FIG. 5, for example, shows the head assembly 16 raised above the table assembly 18. In the preferred embodiment, machine 10 carries two polishing plates, an upper body member or polishing plate 20 and a lower polishing plate 22.

Referring to FIG. 5, in the preferred embodiment, a plurality of hard disks or other workpieces to be polished are carried in a conventional planetary holder 24. The opposed major surfaces of the disks 26 are polished by the conventional polishing plates 20, 22 as the polishing plates are made to undergo relative rotation. In the preferred embodiment, the drive mechanism is of a conventional construction, and is either a "Speedfam Planetary Grinding and Polishing Machine" also referred to as the DSM series Double Sided Machine, commercially available from the Assignee of the present invention.

Referring again to FIG. 1, the upper head assembly 16 is suspended from support frame 28 by a lifting air cylinder 30 having a cylinder shaft 32. Air cylinder 30 is coupled to a control box 36 by air lines 34. Control box 36 supplies raising and lowering signals to air cylinder 30, moving the upper polishing plate 20 toward and away from the lower polishing plate 22. In a cycle of operation, the upper head assembly 16 is raised above the lower table assembly 18 by sending appropriate signals to lifting cylinder 30, thus retracting operating shaft 32. This allows an operator to gain access to the lower polishing plate 22, to load a plurality of disks 26 in the planetary holders 24.

Figure 2:
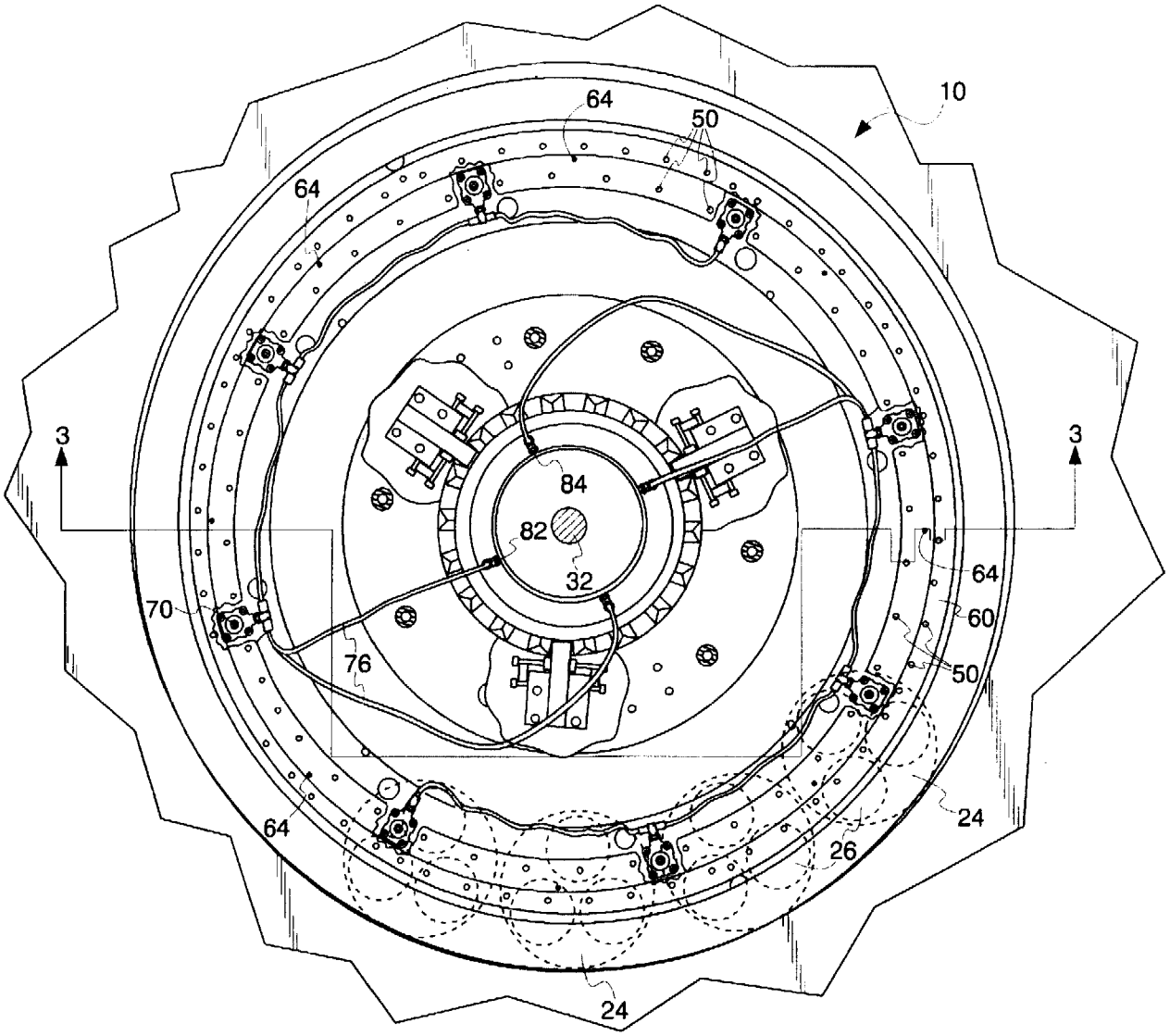
FIG. 2 is a view lying in a plane which is perpendicular to center axis of the upper apparatus, showing the shaft 32 thereof in cross-section.
Figure 4:
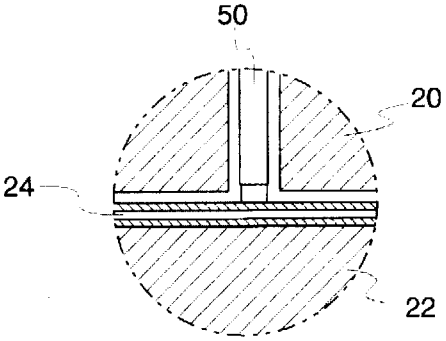
FIG. 4 shows a fragment of FIG. 3 on an enlarged scale.

As can be seen in FIG. 2, each planetary holder of the preferred embodiment holds three disks. In the example shown in FIG. 1, fourteen planetary holders are employed, and accordingly, the operator will load 42 disks or other workpieces in the planetary holders with each cycle of machine operation. Signals are then sent to lifting cylinder 30 to extend operating shaft 32, thereby pressing the disks 26 between the polishing plates 20, 22.

Drive mechanism located in base 38 (see FIG. 1) is then energized to have the polishing plates 20, 22 rotated relative to one another. Conventional abrasive media, such as water-borne abrasive mixtures, are pumped through the upper polishing plate through a series of hoses (not shown) so as to surround the disks 26 with polishing media during a polishing operation. Polishing continues until a desired surface characteristic is obtained on the major faces of the disks 26. The drive mechanism in base 38 is then stopped, thereby stopping relative rotation of the polishing plates 20, 22.

An unloading operation, to remove disks 26 from the polishing machine, is then begun. Appropriate signals are sent to the lifting cylinder 30 to retract operating shaft 32, thereby raising the upper head assembly, as indicated in FIG. 5, to allow an operator access between the polishing plates to grasp and remove the plurality of disks from the polishing machine. In the preferred embodiment, the planetary holders 24 resemble thin plates having three circular holes formed therein for receiving disks to be polished.

After placing the planetary holders 24 on the lower polishing plate 22, the disks 26 are simply dropped into the circular holes of the planetary holders. As will be appreciated by those familiar with the art, considerable suction forces can be experienced which cause the disks to adhere to the upper polishing plate, thus complicating extraction of the disks from the polishing machine. Accordingly, facilities are provided in accordance with the present invention to assist an operator in extracting disks from polishing machine 10 after a polishing operation. Referring to FIG. 3, an optional inner plate 44 is mounted atop the upper polishing plate 20 and has inner ends adjacent the central core 12 of the machine. The optional inner plate 44 is joined to the upper polishing plate 20 So as to be lifted therewith, with operation of lifting cylinder 30.

FIG. 5 shows an outer portion of the inner plate 44. As can be seen in FIG. 5, a plurality of stepped bushings 46 are mounted in the inner plate 44 and extend into the upper polishing plate 20. A push rod 50 is slidingly received in the bushings 46. As shown in FIG. 5, the push rods pass entirely through the upper polishing plate 20, extending through stepped passageways 52. As can be seen for example in FIG. 5, passageways 52 extend to the polishing surface 54 of the upper polishing plate 20, thereby allowing the push rods to extend to the polishing surface 54 and beyond.

Referring to FIG. 6, a portion of the push rod 50 passing through an enlarged head 48 of bushing 46 is shown. Push rod 50 receives an E-clip 56 which interferes with bushing head 48 to limit downward movement of the push rods. Preferably, this limited downward movement is set so that tips 58 of push rods 50 extend slightly beyond surface 54. In some operating conditions, downward movement is restricted by standoff sleeve 66.

Referring to FIGS. 3–7, the upper ends of the push rods 50 are received in a ring-like push plate 60. As can be seen for example in FIG. 2, a considerable number of push rods are employed in the preferred embodiment. During operation of polishing machine 10, the planetary holders 24 rotate about their own central axes and also rotate about the central axis of machine 10. If desired, a sufficient number of push rods can be employed so that at least one push rod is aligned with each disk, regardless of where the disk may be located when machine operation is stopped.

Referring again to FIG. 5, a guide rod 64 is shown received in an aperture formed in push plate 60. As can be seen for example in FIG. 4, a number of guide rods 64 are positioned about the circular push plate 60. It is generally preferred that the number of guide rods 64 employed is substantially less than the number of push rods employed, although differing numbers and percentages of guide rods and push rods can be employed, if desired.

Referring again to FIG. 5, a standoff sleeve 66 is employed between the guide rods 64 and a compression spring 68. The compression spring 68 resists movement of push plate 60 toward the upper polishing plate 20. Referring to FIGS. 1–3 and 13–14, a plurality of air cylinders 70 are mounted on inner plate 44 so as to be disposed about push plate 60. The air cylinders 70 are operated so as to move the push plate 60 toward and away from the polishing plate 20. Referring again to FIGS. 3–7, as the push plate 60 is pulled toward inner plate 44, push plate 60 compresses springs 72 transferring a downward force to E-rings 56, and hence to push rods 50. As indicated in FIG. 7, a washer 74 is located between push plate 60 and spring 72. A washer 74 is affixed to the upper end of push rods 50 to contain the upward pressure applied to push plate 60 by spring 72, and also to ensure a positive engagement and lifting of the push rods when the push plate 60 is raised.

In the preferred embodiment, each of the push rod assemblies are similarly constructed, and likewise, the guide rod assemblies are also made uniform. As indicated in FIG. 2, flexible conduits 76 are connected to the several air cylinders 70 for simultaneous transmission of lifting or lowering signals to each of the air cylinders. As can be seen in FIG. 2, it is generally preferred that equal numbers of air cylinders and guide rods be used, with the air cylinders being equally angularly spaced from the guide rods, although other arrangements are also possible.

Turning now to FIGS. 5–12, operation of the polishing machine will be described. As mentioned, FIG. 5 shows the upper and lower polishing plates separated, so as to allow an operator access to the planetary holder 24, to install workpieces to be polished. The polishing operation is carried out in a conventional manner, with either a single-sided polish on one side of the workpiece, or simultaneous polishing of both sides of the workpiece. Polishing operations of the preferred embodiment are well known in the art, and are carried out with conventional equipment mentioned herein, available from the Assignee of the present invention. During a polishing operation, the upper and lower polishing plates undergo relative rotation, preferably by rotatably driving the lower polish plate at various speeds, and optionally in different directions.

Figure 8:
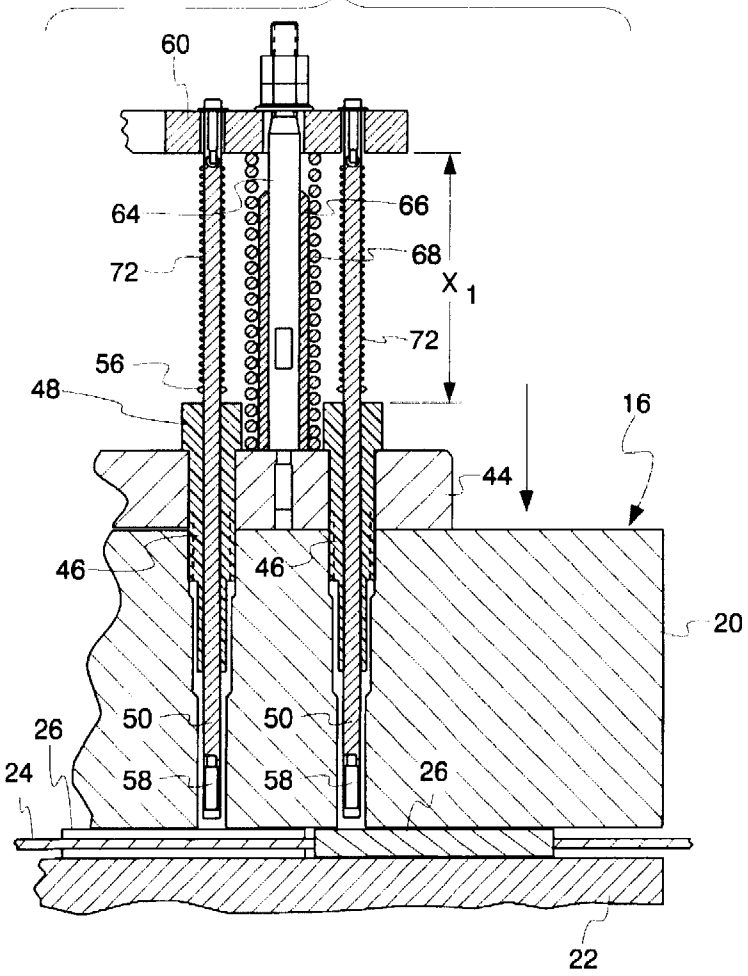

FIG. 8 shows a fragment of the machine upon conclusion of the polishing operation. As can be seen in the Figure, the tips 58 of the push rods 50 are spaced above the disks 26 and holders 24, so as to avoid interfering with the polishing operation. As can be observed in FIG. 8, for example, a small portion of the polishing area of the upper polish plate is lost because of the through holes which receive the push rods 50. This loss in polish area has been found to be negligible with respect to the machine operation.

The arrows in FIG. 8 are used to indicate the relative position of the push rods in the upper push plate as the upper head assembly 16 is lowered with respect to the lower table assembly 18. As mentioned, the relative position of the push rod and upper polish plate are maintained throughout a polishing operation. With the polishing operation completed, preparations are made for raising the upper head assembly, separating the upper polish plate 20 from the lower polish plate 22.

Figure 9:
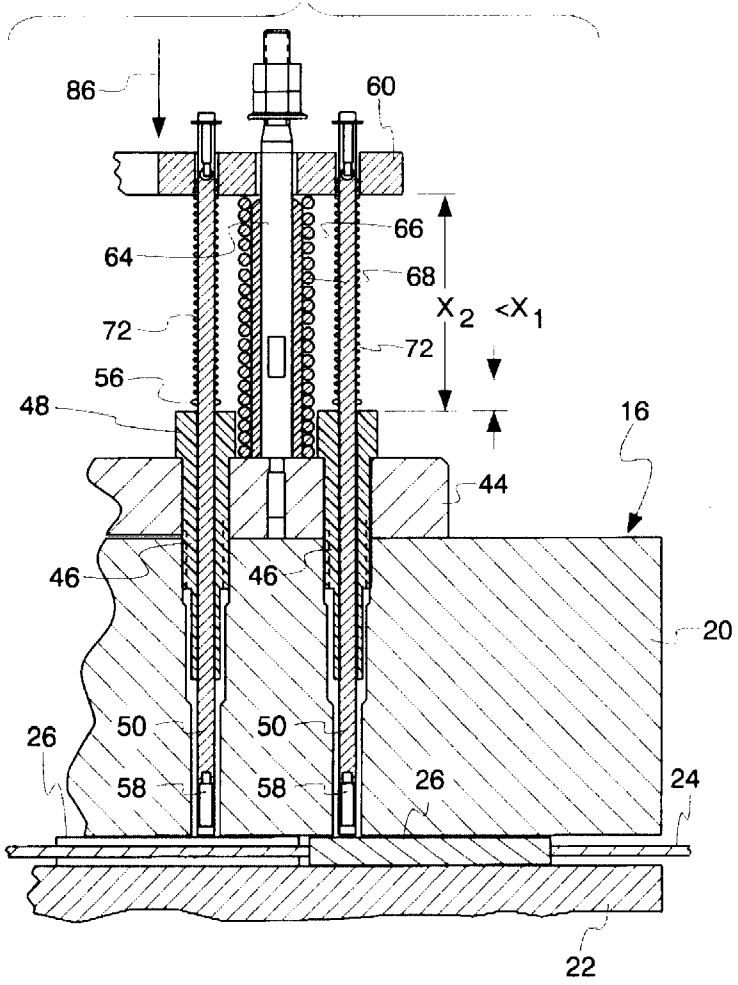
FIGS. 8–12 are views similar to that of FIG. 5, showing a sequence of operation.

Referring to FIG. 2, the various conduits 76 are coupled to a manifold having inlet and outlet lines 82, 84. The lines 82, 84 are in turn coupled to the control box 36. The control box 36 also controls operation of lifting cylinder 30 to provide a coordinated action of the machine components. The air cylinders 70 then receive signals for lowering the push plate 60, thereby compressing the springs 72, 68. Referring to FIG. 8, the distance $X_1$ indicates the rest position of the push plate 60 with respect to the top of the bushing heads 48 which, as mentioned, are fixedly mounted to the upper polishing plate 20. The distance $X_2$ in FIG. 9 has decreased substantially from $X_1$ as the push plate 60 is lowered in the direction of arrow 86 in FIG. 9. As can be seen in FIG. 9, the lower E-clip 56, fixedly mounted to guide rods 50, is advancing toward the top of the bushing heads 48. As push plate 60 is advanced in the direction of arrow 86, spring energy is stored in spring 72, with a portion of the energy of push plate 60 moving the guide rod tips 58 into contact with the disk 26 and holders 24. In the preferred embodiment, all of the push rods are lowered at approximately the same time, although a staged or staggered lowering of the various push rods is also possible.

As mentioned above with respect to FIG. 9, springs 72 are compressed, having stored spring energy. The amount of compression of springs 72 is made sufficiently great so as to allow push plate 60 to maintain the push rods in engagement with the discs as the upper polishing plate 20 is raised. In effect, this will allow the springs 72 to extend slightly, relaxing some of the stored energy. It is desired, however, that the push rod tips 58 remain in engagement with the disk and holder a sufficient time during initial separation of the upper polishing plate 20, during which time any suction between the disk and holder and upper polishing plate is broken. During this time, it is preferred that the distance $X_3$ be held close to the distance $X_2$ shown in FIG. 9, i.e., the air cylinders 70 are held in a fixed operating position. It will be appreciated that, as the upper head assembly is raised, contact between the push rod tips and disks will be maintained, although the pressure force exerted by the push rods will be continuously decreasing.

If desired, the control box 36 can send additional signals during this time to air cylinder 70 to decrease the distance $X_3$ in order to lessen the reduction of pressure force exerted by push rods 50.

Alternatively, the air cylinders 70 can be operated so as to slightly compress, preferably in proportion to the amount of lift of the upper head assembly. This insures that the push rod tips 58 remain in engagement with the disks 26 and holders 24 during initial separation therefrom, from the upper polishing plate 20, while suction forces between the disks, holders and upper polishing plate are broken. If this action is chosen, the length of standoff 66 should be adjusted (reduced) accordingly.

Figure 11:
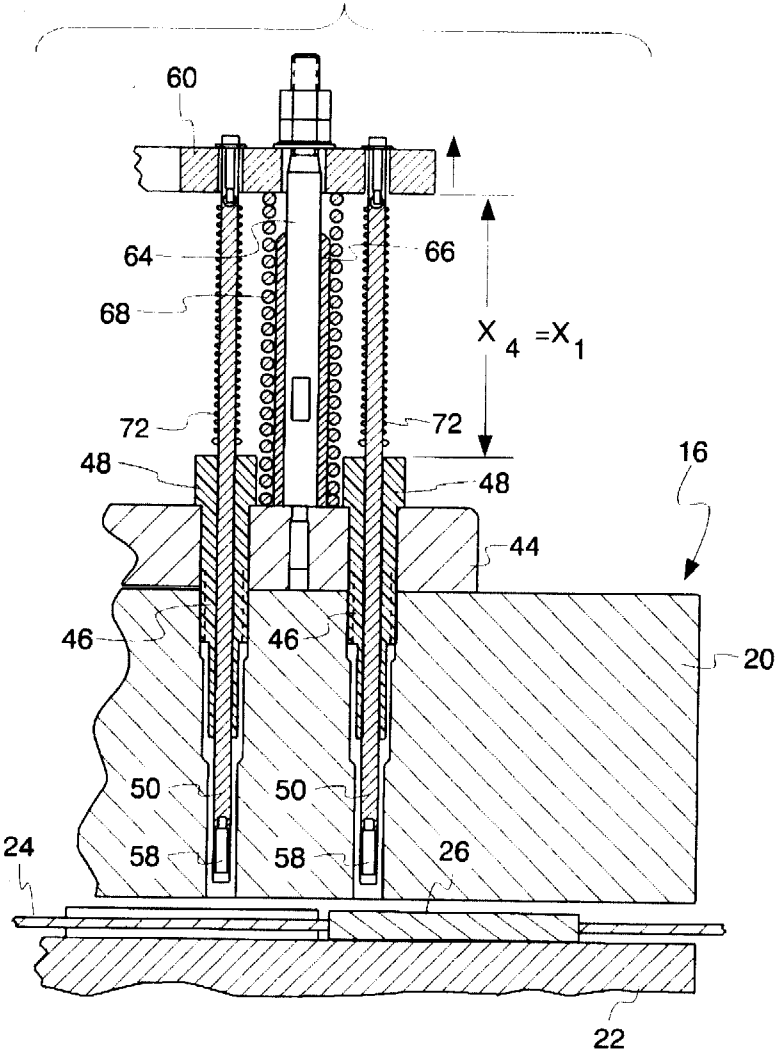
Figure 10:
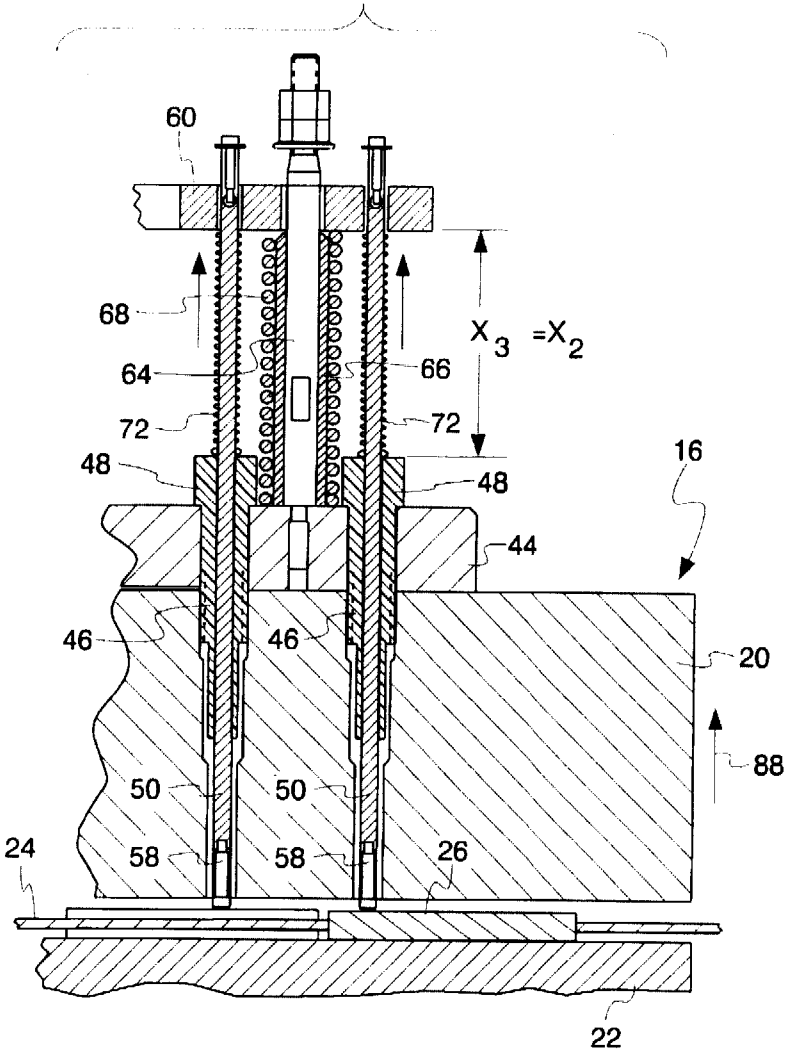
Figure 12:
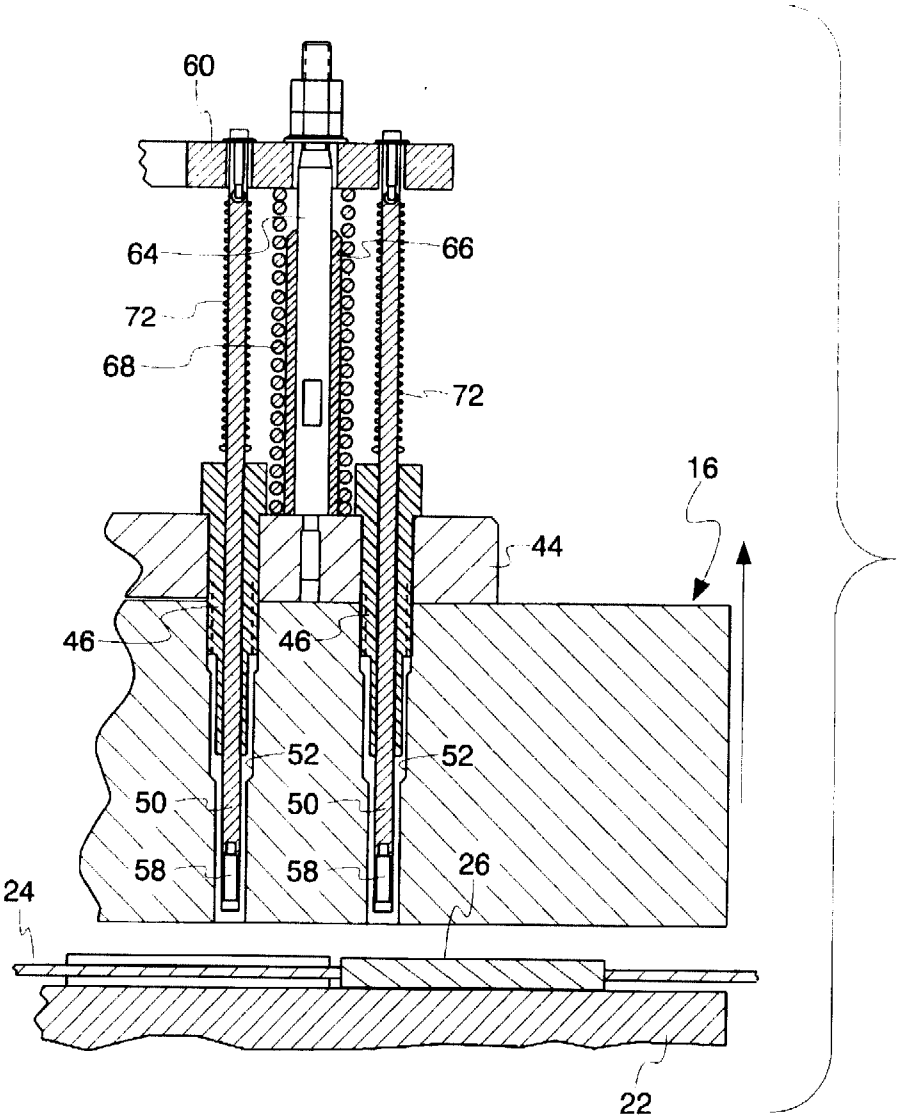
Figure 14:
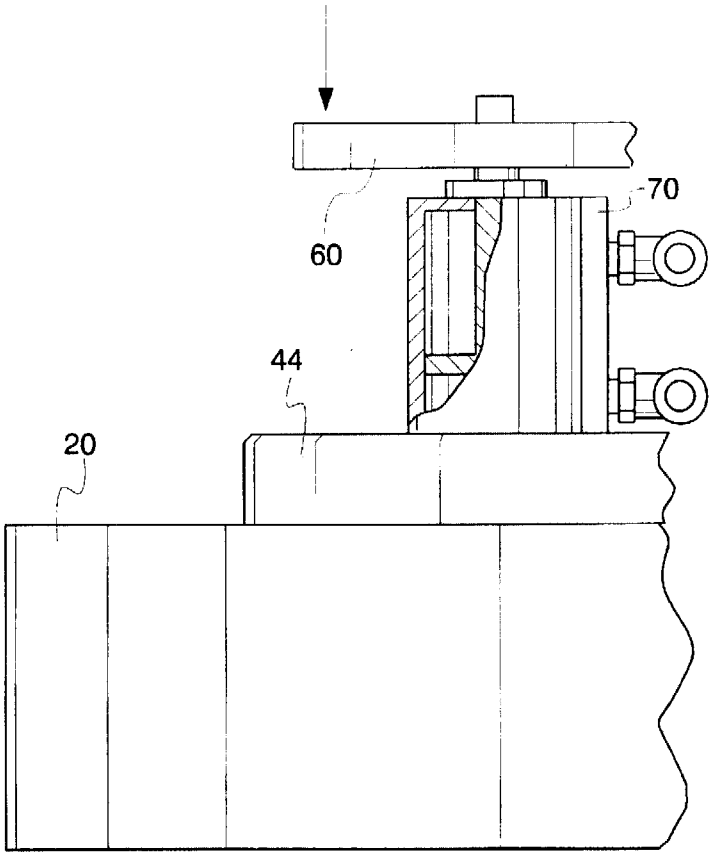
FIG. 14 is a view similar to that of FIG. 13 showing a subsequent sequence of operation.
Figure 13:
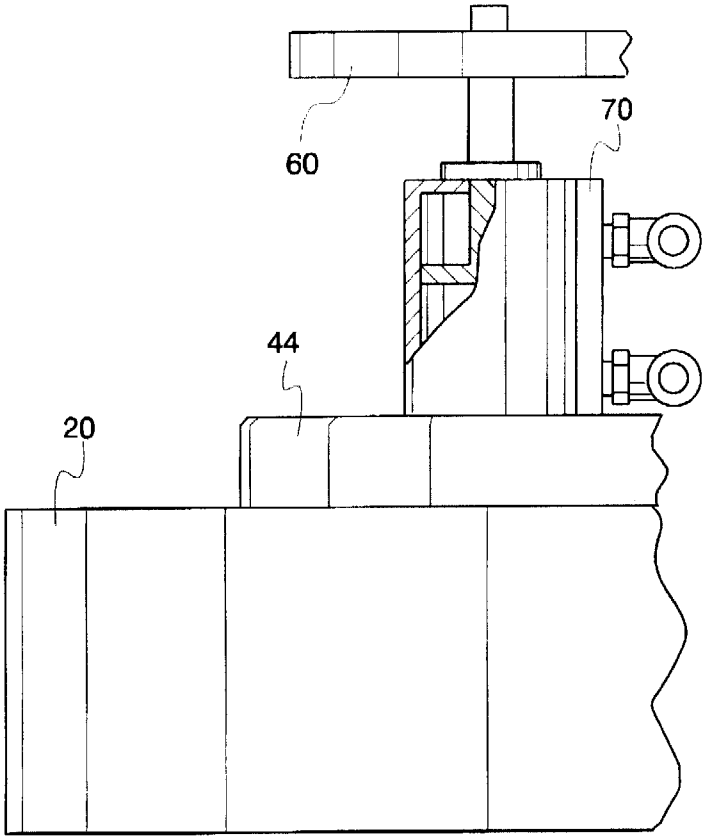
FIG. 13 is a fragmentary view taken from the left hand portion of FIG. 3, shown partly broken away and on an enlarged scale.

Referring now to FIG. 11, as the upper head assembly 16 continues to be raised away from the lower polishing plate, the air cylinders 70 return to their rest position, with the distance $X_4$ in FIG. 11 being approximately the same as the distance $X_1$ in FIG. 8. During the cycles of operation shown in FIGS. 9–11, there is relative movement between the push plate and upper polishing plate. FIG. 11 ends the relative movement, with the returning of air cylinders 70 to their own rest position, assisted by the return of springs 72, 68 to their rest position. It is generally preferred that spring 68 remains under a slight amount of compression during this time, to reduce vibration and noise in the machine. As indicated in FIG. 12, the upper head assembly 16 continues to move in an upward direction to achieve the desired separation between upper and lower polishing plates, to allow an operator ready access for removal and reloading of the disks.

If desired, the control box 36 can be coupled to the rotational drive of the lower polishing plate contained in base 38. Conventional timing means can be added to stop the lower polishing plate, and hence the disks and holders, at a known position beneath the push rods. With reference to FIG. 1, a drive motor 90 for the lower polishing plate includes a gear box 92 and a conventional timing arrangement 94, all of which are coupled by wiring 95 to control box 36. If the control box 36 is unable to consistently stop the lower polishing plate at a known, fixed angular position, thus aligning the disk to the push rods, with sufficient precision, it may be possible to provide a sufficient number of push rods so as to insure sufficient down pressure is exerted against each disk and disk holder to break suction forces during opening of the machine, and such is preferred. As indicated in FIG. 2, each disk and disk holder is aligned with at least one push rod, and in the preferred embodiment the push rods and pushing force has been selected to adequately retain the disk and disk holders in position while suction forces are broken.

If desired, additional channels can be formed in the upper polishing plate to allow pressurized fluid streams to push against the disks and disk holders, to augment the suction breaking effect of the push rods. The air or other fluid, such as water, can be employed in either a continuous or a pulsed mode operation. Further, the pressurized fluid can be introduced into the through holes 52 passing through the upper polishing plate (see FIG. 5) to augment the suction-breaking force of the push rods and/or to clear the throughholes 52 of any foreign matter, such as abrasive media, which may hinder desired operation of the push rods. Further, pressurized fluid in the through hole 52 would provide easier cleaning of the polishing machine. For example, such cleaning may be necessary prior to periods of prolonged shutdown or when an incompatible abrasive media may be left over from a previous job. Such cleaning passages can be readily provided. For example, holes could be drilled form the top surface of the polish plate at an angle so as to emerge at the uppermost step of bushing 46 disposed within the upper polish plate 20.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for polishing a workpiece, comprising:

a table for supporting the workpiece;

an upper head disposed above the table and movable toward the table so as to cooperate with the table to apply pressure to the workpiece to be polished, the upper head also being movable away from the table to allow access to the workpiece for its removal from the apparatus;

means for moving at least one of the table and upper head with respect to the other so as to polish the workpiece;

a push plate carried on the upper head;

a plurality of push rods carried by the upper head so as to be engageable with the workpiece being polished; and means for moving the push plate in a direction toward and away from the table to move the push rods into and out of engagement with the workpiece so as to separate the workpiece from the upper head.

2. The apparatus of claim 1 wherein the push rods are mounted for relative movement with respect to the upper head, to be movable toward and away from the table when the push plate is moved toward and away from the table.

3. The apparatus of claim 1 further comprising resilient bias means between the push plate and the push rods for coupling a pushing force of the push plate to urge the push rods into engagement with the workpiece.

4. The apparatus of claim 1 further comprising resilient biasing means for urging the push plate away from the table.

5. The apparatus of claim 1 wherein the upper head includes a working surface facing toward the table, and defines passageways extending to the working surface.

6. The apparatus of claim 5 wherein the push rods extend beyond the working surface.

7. The apparatus of claim 6 wherein the upper head defines passageways for receiving the push rods.

8. The apparatus of claim 7 further comprising sleeves received in the passageways for, in turn, receiving respective ones of said push rods.

9. The apparatus of claim 1 further comprising guide rods carried by the upper head, and wherein the push plate defines apertures for receiving the guide rods.

10. The apparatus of claim 1 wherein the push plate comprises an annular ring.

11. The apparatus of claim 10 wherein the push rods are disposed along at least one circular path about the annular ring.

12. Apparatus for polishing a workpiece, comprising:

a table for supporting the workpiece;

an upper head disposed above the table and movable toward the table so as to cooperate with the table to apply pressure to the workpiece to be polished, the upper head also being movable away from the table to allow access to the workpiece for its removal from the apparatus;

means for moving at least one of the table and upper head with respect to the other so as to polish the workpiece;

a push plate carried on the upper head;

a plurality of push rods carried by the upper head so as to be engageable with the workpiece being polished; and means for engaging the push rods with the push plate to move the push rods into engagement with the workpiece so as to separate the workpiece from the upper head.

13. The apparatus of claim 12 wherein the push rods are mounted for relative movement with respect to the upper head, toward and away from the table when the push plate is moved toward and away from the table.

14. The apparatus of claim 13 further comprising resilient bias means between the push plate and the push rods for coupling a pushing force of the push plate to urge the push rods into engagement with the workpiece.

15. The apparatus of claim 13 wherein the push plate comprises an annular ring.

16. The apparatus of claim 13 wherein the push rods are disposed along at least one circular path about the annular ring.

17. The apparatus of claim 12 further comprising guide rods carried by the upper head, and wherein the push plate defines apertures for receiving the guide rods for movement of the push plate therealong.

18. The apparatus of claim 17 further comprising resilient biasing means for urging the push plate in a direction away from the table.

19. The apparatus of claim 17 wherein the upper head defines passageways for receiving the push rods.

20. The apparatus of claim 19 further comprising sleeves in the passageways for, in turn, receiving respective ones of said push rods.

21. The apparatus of claim 20 wherein the upper head includes a working surface facing toward the table, and wherein the passageways extend to the working surface.

22. The apparatus of claim 21 wherein the push rods extend beyond the working surface.

23. In an apparatus for polishing a workpiece, including a table for supporting the workpiece, an upper head assembly having a body member, the upper head assembly disposed above the table so as to be movable toward the table, the upper head assembly cooperating with the table to apply pressure to the workpiece to be polished, the upper head assembly also being movable away from the table to allow access to the workpiece for its removal from the apparatus, and means for moving at least one of the table and upper head with respect to the other so as to polish the workpiece, the improvement in the upper head assembly comprising:

a push plate carried on the body member;

a plurality of push rods carried by the body member so as to be engageable with the workpiece being polished; and means for moving the push plate toward and away from the table to move the push rods into and out of engagement with the workpiece so as to separate the workpiece from the upper head assembly.

24. The apparatus of claim 23 wherein the body member defines passageways for receiving the push rods.

25. The apparatus of claim 24 wherein the push rods are mounted for relative movement with respect to the body member, toward and away from the table when the push plate is moved toward and away from the table.

26. The apparatus of claim 25 further comprising resilient bias means between the push plate and the push rods for coupling pushing force of the push plate to urge the push rods into engagement with the workpiece.

27. The apparatus of claim 25 further comprising resilient biasing means for urging the push plate away from the table.

28. The apparatus of claim 25 wherein the body member includes a working surface facing toward the table, and wherein the passageways extend to the working surface.

29. The apparatus of claim 28 wherein the working surface comprises a polishing surface and the table comprises a polishing surface.

30. The apparatus of claim 29 wherein the push rods extend beyond the working surface.

31. The apparatus of claim 26 further comprising guide rods carried by the upper head, and wherein the push plate defines apertures for receiving the guide rods.

32. The apparatus of claim 24 wherein the push plate comprises an annular ring.

33. The apparatus of claim 32 wherein the push rods are disposed along at least one circular path about the annular ring.

34. The apparatus of claim 24 further comprising sleeves in the passageways for, in turn, receiving respective ones of said push rods.

* * * * *